United States Patent [19]

Ishiguro et al.

[11] 4,266,018

[45] May 5, 1981

[54] SILVER HALIDE PHOTOGRAPHIC EMULSIONS

[75] Inventors: Shoji Ishiguro; Tadao Shishido; Takeo Sakai; Noboru Sasaki, all of Minami-ashigara; Joji Nagaoka, Tokyo; Minoru Matsuki, Asaka, all of Japan

[73] Assignee: Fuji Photo Film Co., Ltd., Minami-ashigara, Japan

[21] Appl. No.: 78,622

[22] Filed: Sep. 25, 1979

[30] Foreign Application Priority Data

Sep. 25, 1978 [JP] Japan ..... 53-117669

[51] Int. Cl.[3] ..... G03C 1/28; G03C 1/34

[52] U.S. Cl. ..... 430/550; 430/551; 430/600; 430/611

[58] Field of Search ..... 430/600, 550, 611, 551, 430/603

[56] References Cited

U.S. PATENT DOCUMENTS

| | | | |
|---|---|---|---|
| 3,287,137 | 11/1966 | McBride | 430/600 |
| 3,501,313 | 3/1970 | Willems et al. | 430/600 |
| 4,116,697 | 9/1978 | Bigelow | 430/600 |
| 4,140,530 | 2/1979 | Trunley et al. | 430/569 |

FOREIGN PATENT DOCUMENTS

| | | | |
|---|---|---|---|
| 594809 | 3/1960 | Canada | 430/603 |
| 1178683 | 1/1970 | United Kingdom | 430/603 |

OTHER PUBLICATIONS

Rahmani, et al.: Studies on Mixed Ligand Complexes of Silver (I), J. Inorg. Nucl. Chem., Series 39, Issue 11, pp. 2089–2092, 1977.

*Primary Examiner*—Won H. Louie, Jr.

*Attorney, Agent, or Firm*—Sughrue, Rothwell, Mion, Zinn and Macpeak

[57] ABSTRACT

A silver halide photographic emulsion chemically sensitized by a sulfur compound of the formula:

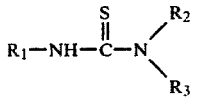

wherein $R_1$ represents a 5-membered or 6-membered heterocyclic ring containing a nitrogen atom; $R_2$ represents a hydrogen atom, a lower alkyl group, an allyl group, an aryl group, or an aralkyl group; and $R_3$ has the same definition as $R_1$ or $R_2$; or $R_2$ and $R_3$ may join to form a heterocyclic ring; is disclosed.

22 Claims, No Drawings

SILVER HALIDE PHOTOGRAPHIC EMULSIONS

BACKGROUND OF THE INVENTION

1. Field of the Invention

This invention relates to a silver halide photographic emulsion and more particularly to a silver halide photographic emulsion chemically sensitized by a sulfur compound. The invention also relates to photographic materials containing such silver halide emulsions.

2. Description of the Prior Art

Various chemical sensitizations for increasing the light sensitivity of silver halide photographic emulsions are known. One of the typical methods is known as a sulfur sensitization wherein the light sensitivity of a silver halide photographic emulsion is increased by adding thereto a very small amount of sulfur or a sulfur compound to form silver sulfide as disclosed, for example, in U.S. Pat. Nos. 2,410,689 and 3,501,313, West German Pat. No. 1,422,869 and Japanese Patent Publication No. 20533/74.

Also, a method of increasing the light sensitivity of silver halide photographic emulsions by adding thereto a suitable reducing agent or gold compound is known as a reduction sensitization method or gold sensitization method respectively as disclosed, for example, in U.S. Pat. Nos. 2,399,083 and 3,297,446.

Furthermore, it is known to further increase the light sensitivity of silver halide emulsions by a combination of these sensitization methods as described in T. H. James, *The Theory of the Photographic Process,* 4th Edition, pp. 149 to 160 (Macmillan Co., 1977).

In these convetional sensitization methods, as the amount of sensitizer is increased to obtain higher light sensitivity, the silver halide photographic emulsions form fog greatly and it is difficult to control the formation of fog even by using antifoggants or stabilizers. Also, the silver halide photographic emulsions sensitized by such conventional sensitization methods have a disadvantage that when photographic films prepared by coating such silver halide emulsions are stored under high temperature and high humidity conditions, the photographic characteristics change greatly.

Attempts to improve the light sensitivity of silver halide emulsions by prolonging the chemical ripening period or increasing the ripening temperature are accompanied by an increase in the formation of fog and it is difficult to attain the desired purpose.

SUMMARY OF THE INVENTION

It is, accordingly, a first object of this invention to provide silver halide photographic emulsions the sensitivity of which has been improved without being accompanied by an increase of fog harmful to the photographic characteristics.

A second object of this invention is to provide silver halide photographic emulsions which are subject to less of an increase in fog and less of a reduction in sensitivity when stored under high temperature and high humidity conditions.

A third object of this invention is to provide a method of increasing the sensitivity of silver halide photographic emulsions without the increase in fog harmful for the photographic characteristics.

These objects of this invention have been attained by silver halide photographic emulsions containing a compound represented by the formula (I):

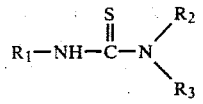

(I)

wherein $R_1$ represents a 5-membered or 6-membered heterocyclic ring containing a nitrogen atom; $R_2$ represents a hydrogen atom, a lower alkyl group, an allyl group, an aryl group, or an aralkyl group; and $R_3$ has the same definition as $R_1$ or $R_2$; or $R_2$ and $R_3$ may combine to form a heterocyclic ring.

DETAILED DESCRIPTION OF THE INVENTION

In formula (I) above, $R_1$ represents a heterocyclic residue and preferably an unsaturated heterocyclic residue. The heterocyclic ring may contain a hetero atom in addition to the nitrogen atom selected from the group consisting of an oxygen atom, a sulfur atom, a selenium atom and a second nitrogen atom. Examples of the heterocyclic ring are, for example, a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring, a naphthoselenazole ring, etc. These heterocyclic rings may be substituted by a straight-chain, branched-chain or cyclic alkyl group having 1 to 8 carbon atoms, preferably 1 to 4 carbon atoms (e.g., a methyl group, an ethyl group, etc.); a straight-chain, branched-chain or cyclic alkoxy group having 1 to 8 carbon atoms, preferably 1 to 4 carbon atoms (e.g., a methoxy group, an ethoxy group, etc.); a mono- or bicyclic aryl group having 6 to 18 carbon atoms (e.g., a phenyl group, etc.); a halogen atom (e.g., chlorine, bromine, etc.); an alkylthio group having 1 to 4 carbon atoms (e.g., a methylthio group, etc.); an aralkyl group having 7 to 15 carbon atoms (e.g., a benzyl group, etc.); an amido group; a sulfo group; a carboxy group; an alkoxysulfonyl group wherein the alkyl moiety has 1 to 4 carbon atoms; or an alkoxycarbonyl group wherein alkyl moiety has 1 to 4 carbon atoms.

Examples of the lower straight, branched or cyclic chain alkyl group represented by $R_2$ are an unsubstituted alkyl group having 1 to 6 carbon atoms (e.g., a methyl group, an ethyl group, an n-propyl group, an isobutyl group, an isoamyl group, etc.). The alkyl group represented by $R_2$ may be substituted by, for example, a hydroxy group, a cyano group, an amino group, etc. Representative examples of substituted alkyl groups include a hydroxyalkyl group (e.g., hydroxyethyl group, etc.), a cyanoalkyl group (e.g., cyanoethyl group, etc.), an aminoalkyl group (e.g., dimethylaminoethyl group, etc.) and the like.

The aryl group represented by $R_2$ is a mono- or bicyclic aryl group having 6 to 12 carbon atoms and may be substituted by an alkyl group having 1 to 8 carbon atoms, an alkoxy group having 1 to 8 carbon atoms, a halogen atom, a carboxy group or a sulfo group. Examples of the aryl group represented by $R_2$ are a phenyl group, a naphthyl group, a p-tolyl group, a p-chlorophenyl group, etc.

The aralkyl group represented by $R_2$ has 7 to 15 carbon atoms and the aryl moiety in the group may be monocyclic or bicyclic. Examples of the aralkyl group are a benzyl group, a phenethyl group, etc.

$R_2$ and $R_3$ may combine to form a 5-, 6- or 7-membered saturated heterocyclic ring containing one or two hetero atoms such as a nitrogen atom, an oxygen atom or a sulfur atom. Examples of such a heterocyclic ring are a morpholine ring, a piperidine ring, a piperazine ring, a pyrrolidine ring, etc.

Representative examples of the compounds represented by the formula (I) are illustrated below:

Compound 1

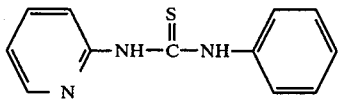

Compound 2

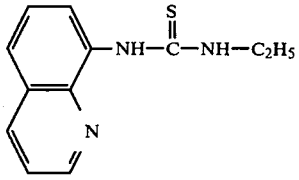

Compound 3

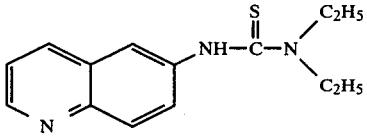

Compound 4

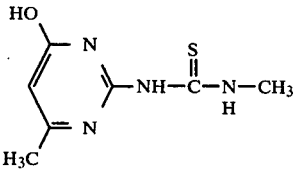

Compound 5

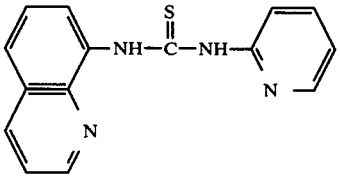

Compound 6

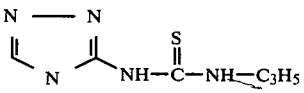

Compound 7

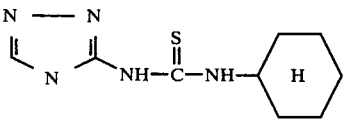

Compound 8

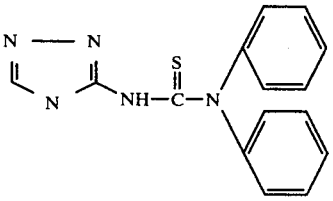

Compound 9

-continued

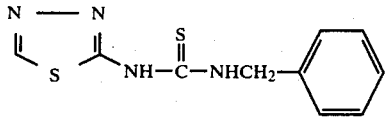

Compound 10

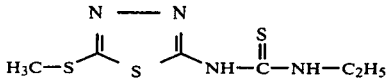

Compound 11

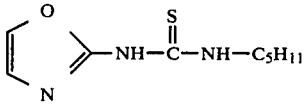

Compound 12

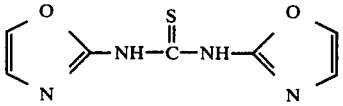

Compound 13

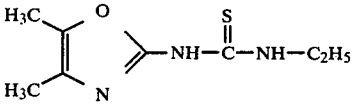

Compound 14

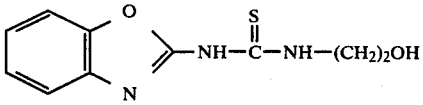

Compound 15

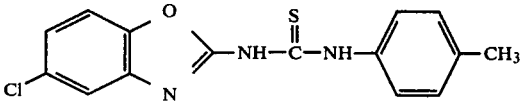

Compound 16

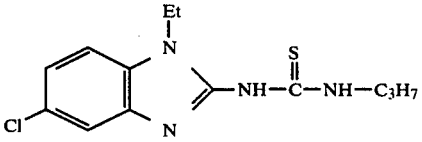

Compound 17

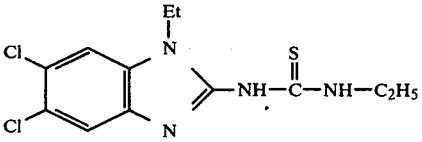

Compound 18

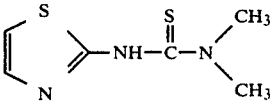

Compound 19

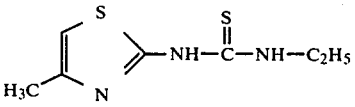

Compound 20

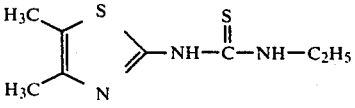

Compound 21

-continued

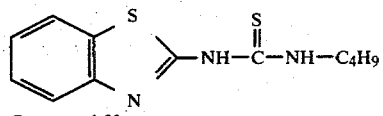

Compound 22

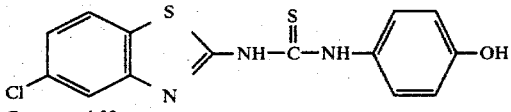

Compound 23

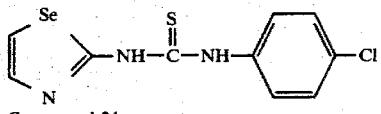

Compound 24

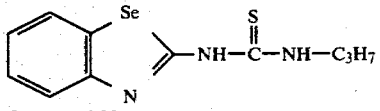

Compound 25

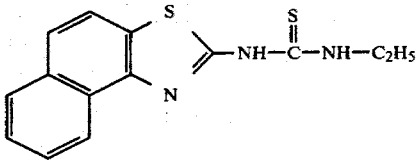

Compound 26

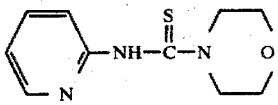

Compound 27

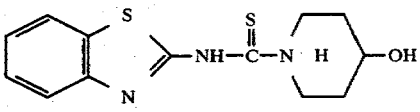

The sulfur compound used in the present invention can be easily prepared by reacting a corresponding amine and a corresponding isothiocyanate, as described, for example, in *Organic Synthesis,* Vol. III, pp. 617–618, according to the reaction:

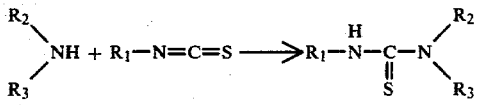

The compound of this invention may be added to silver halide photographic emulsions at any stage of preparing the emulsions as desired but generally it is preferred to add the compound after washing the silver halide emulsions or at the initiation of chemical ripening.

The amount of the compound of this invention added to silver halide emulsions depends upon the kind of silver halide photographic emulsions, the kind of the compound used, etc., but it is usually added in an amount of about $5\times10^{-6}$ mol to $1\times10^{-3}$ mol per mol of silver halide.

The value of pAg (logarithm of the reciprocal of a silver ion concentration) at chemical ripening is preferably about 8.0 to 11.0.

At chemical ripening, other chemical sensitizers may be used together with the compound of the present invention. Examples of such chemical sensitizers are the gold compounds described, for example, in U.S. Pat. Nos. 2,399,083, 2,597,856, 2,597,915, etc.; reducing materials as the amines, stannous salts, etc., described, for example, in U.S. Pat. Nos. 2,487,850, 2,518,698, 2,521,925, 2,521,926, 2,419,973, 2,694,637, 2,983,610, etc.; and the salts of noble metals as platinum, palladium, iridium, rhodium, etc., described, for example, in U.S. Pat. Nos. 2,448,060, 2,566,245, 2,566,263, etc.

The silver halide used for the silver halide photographic emulsions of this invention includes silver bromide, silver iodobromide, silver chloroiodobromide, silver chlorobromide, etc., but silver bromide and silver iodobromide are particularly preferred.

There is no particular limitation on the mean grain size of silver halide grains used in this invention (the mean grain size is the mean value based on the projection area of the diameters of grains when the silver halide grains are spherical or similar grains or the edge length when the silver halide grains are cubic grains) but it is preferred that the grain size be 3 microns or less, particularly 0.4 to 3.0 microns. The grain size distribution may be narrow or broad.

The silver halide grains in the silver halide photographic emulsions of this invention may have a regular crystal form such as a cube or an octahedron, or an irregular crystal form such as a globular form or plate crystal, or are composed of a mixture of grains of various crystal forms.

The silver halide grains used in this invention may have different phases between the inside and the surface layer or may be composed of a homogeneous phase. Also, the silver halide grains may be the type that a latent image is mainly formed at the surface thereof or the type that a latent image is mainly formed in the inside thereof.

The silver halide photographic emulsions of this invention may be prepared by the methods described in *Chimie et Physique Photographique* edited by P. Glafkides (Paul Montel, 1967); G. F. Diffin, *Photographic Emulsion Chemistry* (The Focal Press, 1966); and V. L. Zelikman, et al, *Making and Coating Photographic Emulsion* (The Focal Press, 1964). That is, they may be prepared by an acid method, a neutralization method, an ammonia method, etc., and for the system of reacting a soluble silver salt and a soluble halide, a one side mixing method, a simultaneous mixing method, or the combination of them may be used.

The silver halide grains may be prepared using a so-called reverse mixing method that they are formed in the presence of an excessive amount of silver ions. As one system of the simultaneous mixing method, a so-called controlled double jet method wherein the pAg value of the liquid phase forming silver halide is maintained constant. According to this method, a silver halide emulsion in which the crystal form is regular and the grain sizes are almost uniform is obtained.

Two or more kinds of silver halide emulsions which were prepared separately may be used as a mixture.

Also, a cadmium salt, a zinc salt, a lead salt, a thallium salt, an iridium salt or a complex salt thereof, a rhodium salt or a complex salt thereof, or an iron salt or a complex salt thereof may exist in the state of forming or physical ripening of silver halide grains.

The silver halide photographic emulsions of this invention may contain various compounds for preventing the formation of fog during the production of photographic materials, preserving or processing the photographic materials, or for stabilizing the photographic properties of the photographic materials. For example, there are many compounds known as antifoggants or stabilizers such as azoles as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines; mercaptotriazines; thioketo compounds as oxazolinethione; azaindenes as triazaindenes, tetraazaindenes (in particular, 4-hydroxy substituted (1,3,3a,7)tetraazaindene), pentaazaindenes, etc.; benzenethiosulfonic acid; benzenesulfinic acid; and benzenesulfonic acid amide. Among these stabilizers, tetraazaindenes are particularly preferred. These stabilizers are preferably added at chemical ripening or before coating silver halide emulsions.

The silver halide photographic emulsions of this invention may contain an inorganic or organic hardening agent. For example, a chromium salt (chromium alum, chromium acetate, etc.), an aldehyde (formaldehyde, glyoxal, glutaraldehyde, etc.), an N-methylol compound (dimethylol urea, methyloldimethyl hydantoin, etc.), a dioxane derivative (2,3-dihydroxydioxane, etc.), an active vinyl compound (1,3,5-triacryloylhexahydro-S-triazine, bis(vinylsulfonyl)methyl ether, etc.), an active halogen compound (2,4-dichloro-6-hydroxy-S-triazine, etc.), a mucohalogenic acid (mucochloric acid, mucophenoxychloric acid, etc.), an isooxazole, a dialdehyde starch, 2-chloro-6-hydroxytriazinylated gelatin, etc. These agents may be used as the hardening agent alone or in combination.

The silver halide photographic emulsions of this invention may contain color image forming couplers, i.e., compounds capable of forming dyes by reacting with the oxidation product of an aromatic amine (usually primary amine) developing agent (hereinafter such compounds are referred to as couplers). It is preferred that the couplers are nondiffusible having a hydrophobic group called ballast group in the molecule. The couplers may be 4-equivalent couplers or 2-equivalent couplers. The couplers may include colored couplers having a color correction effect or so-called DIR couplers, i.e., couplers releasing development inhibitors with development. Furthermore, the couplers may be ones forming colorless coupling reaction products.

For yellow forming couplers, known closed chain ketomethylene series couplers can be used. Among them, benzoylacetanilide series compounds and pivaloylacetanilide series compounds are advantageously used. Practical examples of the yellow forming couplers are described in U.S. Pat. Nos. 2,875,057, 3,265,506, 3,408,194, 3,551,155, 3,582,322, 3,725,072, and 3,891,445, West German Pat. No. 1,547,868 and West German Patent Application (OLS) Nos. 2,213,461, 2,219,917, 2,261,361, 2,263,875, and 2,414,006.

For magenta forming couplers, pyrazolene series compounds, indazolone series compounds, and cyanoacetyl series compounds can be used but among them, pyrazolone series compounds are particularly advantageous. Practical examples of the magenta forming couplers are described in U.S. Pat. Nos. 2,600,788, 2,983,608, 3,062,653, 3,127,269, 3,311,476, 3,419,391, 3,519,429, 3,558,319, 3,583,322, 3,615,506, 3,834,908, and 3,891,445, West German Pat. No. 1,810,464, West German Patent Application (OLS) Nos. 2,408,665, 2,417,945, 2,418,959, and 2,424,467, and Japanese Patent Publication No. 6031/65.

For cyan forming couplers, phenol series compounds and naphthol series compounds can be used. Practical examples of cyan forming couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, and 3,767,411, West German Patent Application (OLS) Nos. 2,414,830 and 2,454,329, and Japanese Patent Application (OPI) No. 59838/73 (The term "OPI" as used herein refers to a "published unexamined Japanese patent application").

Examples of the colored couplers used in this invention are described, for example, in U.S. Pat. Nos. 3,476,560, 2,521,908, and 3,034,892, Japanese Patent Publication Nos. 2016/69, 22335/63, 11304/67 and 32461/69, Japanese Patent Application Nos. 98469/74 and 118029/75, and West German Patent Application (OLS) No. 2,418,959.

Examples of DIR couplers used in this invention are described, for example, in U.S. Pat. Nos. 3,227,554, 3,617,291, 3,710,783, 3,790,384, and 3,632,345, West German Patent Application (OLS) Nos. 2,414,006, 2,454,301 and 2,454,329, British Pat. No. 953,454, and Japanese Patent Application No. 146570/75.

The photographic materials of this invention may contain compounds releasing development inhibitors at development in place of the DIR couplers and these compounds are described, for example, in U.S. Pat. Nos. 3,297,445 and 3,379,529, and West German Patent Application (OLS) No. 2,417,914.

The above-described couplers may be incorporated in a same silver halide emulsion layer or two or more silver halide emulsion layers. Also, a same coupler may be incorporated in two or more different emulsion layers.

For introducing these couplers in silver halide emulsion layers, a known method as described, for example, in U.S. Pat. No. 2,322,027 may be used. For example, a coupler is dissolved in a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), etc., or an organic solvent boiling at about 30° to 150° C., for example, a lower alkyl acetate as ethyl acetate, butyl acetate, etc., ethyl propionate, secondary butyl alcohol, methyl isobutyl ketone, $\beta$-ethoxyethyl acetate, methyl cellosolve acetate, etc., and then the solution of the coupler is dispersed in an aqueous solution of a hydrophilic colloid. A mixture of the above-mentioned high-boiling organic solvent and low-boiling organic solvent may be used for the aforesaid purpose.

When a coupler has an acid group such as carboxylic acid, sulfonic acid, etc., it is introduced into an aqueous solution of a hydrophilic colloid as an alkaline aqueous solution.

The amount of these couplers employed is from about $2\times10^{-3}$ mol to $5\times10^{-1}$ mol, preferably from $1\times10^{-2}$ mol to $5\times10^{-1}$ mol per mol of silver in silver halide emulsions.

The photographic materials prepared using the silver halide photographic emulsions of this invention may further contain hydroquinone derivatives, aminophenol derivatives, gallic acid derivatives, ascorbic acid derivatives, etc., as color fog preventing agents. Practical examples of these materials are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75 and 110337/75, and Japanese Patent Publication No. 23813/75.

The silver halide photographic emulsion layers and other hydrophilic colloid layers of photographic materials prepared using the silver halide photographic emulsions of this invention may further contain a wide variety of surface active agents for various purposes such as for improving coating property, preventing antistatic phenomenon, improving slipping property, improving emulsified dispersion, preventing adhesion as well as improving photographic characteristics (e.g., development acceleration, contrasting, sensitization, etc.).

Examples of these surface active agents are nonionic surface active agents such as saponin (steroid series), alkylene oxide derivatives (e.g., polyethylene glycol, polyethylene glycol/polypropylene glycol condensate, polyethylene glycol alkyl ether, polyethylene glycol alkylaryl ether, polyethylene glycol esters, polyethylene glycol sorbitan esters, polyalkylene glycol alkylamines, polyalkylene glycol alkylamides, polyethylene oxide addition products of silicones, etc.), glycidol derivatives (e.g., polyglyceride alkenylsuccinate, alkylphenol polyglyceride, etc.), fatty acid esters of polyhydric alcohols, alkyl esters of sugar, urethanes and ethers; anionic surface active agents containing acid groups as carboxy group, sulfo group, phospho group, sulfuric acid ester group, phosphoric acid ester group, etc., such as triterpenoidsaponin, alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine imides, amine oxides, etc.; and cationic surface active agents such as alkylamines, aliphatic quaternary ammonium salts, aromatic quaternary ammonium salts, heterocyclic quaternary ammonium salts (e.g., pyridinium, imidazolium, etc.), phosphonium or sulfonium salts containing heterocyclic rings, and aliphatic phosphonium or sulfonium salts.

Practical examples of these surface active agents are described in U.S. Pat. Nos. 2,240,472, 2,831,766, 3,158,484, 3,210,191, 3,294,540, and 3,507,660, British Pat. Nos. 1,012,495, 1,022,878, 1,179,290, and 1,198,450, Japanese Patent Application (OPI) No. 117414/75, U.S. Pat. Nos. 2,739,891, 2,823,123, 3,068,101, 3,415,649, 3,666,478, and 3,756,828, British Pat. No. 1,397,218, U.S. Pat. Nos. 3,133,816, 3,441,413, 3,475,174, 3,545,974, 3,726,683 and 3,843,368, Belgian Pat. No. 731,126, British Pat. Nos. 1,138,514, 1,159,825, 1,374,780, Japanese Patent Publication Nos. 378/65, 379/65 and 13822/68, U.S. Pat. Nos. 2,271,623, 2,288,226, 2,944,900, 3,253,919, 3,671,247, 3,772,021, 3,589,906, 3,666,478 and 3,754,924, West German Patent Application (OLS) No. 1,961,638, and Japanese Patent Application (OPI) No. 59025/75.

Furthermore, the photographic materials using the silver halide photographic emulsions of this invention contains a wide variety of additives for photography such as antistatic agents, binder-vehicles, polymer latexes, matting agents, whitening agents, spectral sensitizing dyes, dyestuffs, etc. These additives as well as the supports for the photographic materials, coating methods, developing methods for these photographic materials, etc., may refer to the descriptions of *Research Disclosure,* Vol. 92, 107–110 (1971, Dec.).

The photographic materials using the silver halide photographic emulsions of this invention have high sensitivity with the formation of less fog. Also, when the photograhic materials are preserved for a long period of time under high temperature and high humidity conditions, the reduction in photographic properties such as the increase of fog with the passage of time, the reduction in sensitivity, etc., is less.

Then, the invention will be described more practically by referring to the following examples.

EXAMPLE 1

After adding the compound shown in Table 1 to a silver iodobromide gelatino emulsion (mean grain size of silver halide grains being 0.8 micron) containing 6 mol% silver halide, the emulsion was heated for 60 minutes at 60° C. to perform ripening. In this case, pAg of the emulsion was 8.8. Then, after adding to the silver halide emulsion 4-hydroxy-6-methyl-1,3,3a,7-tetraazaindene as a stabilizer, sodium dodecylbenzenesulfonate as a wetting agent, and 2,4-dichloro-6-hydroxy-S-triazine as a hardening agent, the resultant mixture was coated on a cellulose acetate and dried at a dry thickness of 5 microns. Thus, samples 1 to 9 were prepared.

Each of the samples was exposed (1/20 sec.) through an optical wedge using a sensitometer, developed for 7 minutes at 20° C. using a developer, Kodak D-76, and then fixed, washed and dried in an ordinary manner. Then, the photographic properties (sensitivity and fog) were measured on each sample, the results are shown in Table 1.

In addition, a photographic sensitivity is shown by the logarithm of a reciprocal of the exposure amount required for obtaining the optical density of fog value + 0.2 but in Table 1 the sensitivity of Sample 1 (Emulsion 1) is taken as 100 and other sensitivities are shown relatively. The amount of the compounds shown in Table 1 is the amount per mol of silver halide.

TABLE 1

| Sample No. | Compound | Addition Amount (mol) | Sensitivity | Fog |
|---|---|---|---|---|
| 1 | (A)* | $2.5 \times 10^{-4}$ | 100 | 0.16 |
| 2 | (A)* | $1.0 \times 10^{-4}$ | 46 | 0.10 |
| 3 | (B)** | $2.5 \times 10^{-4}$ | 105 | 0.14 |
| 4 | 2 | $1.0 \times 10^{-4}$ | 135 | 0.11 |
| 5 | 8 | " | 126 | 0.10 |
| 6 | 14 | " | 110 | 0.12 |
| 7 | 17 | " | 135 | 0.12 |
| 8 | 19 | " | 135 | 0.10 |
| 9 | 22 | " | 126 | 0.11 |

*Comparison Compound (A): $Na_2S_2O_3$
**Comparison Compound (B):

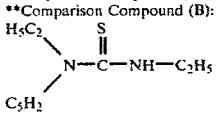

As is clear from the results of Table 1, the samples using the compounds of this invention had high photographic sensitivity and showed less formation of fog as compared with the samples using comparison compounds (A) and (B).

EXAMPLE 2

After adjusting a silver iodobromide gelatino emulsion (mean grain size of silver halide grains being 1.2 microns) containing 2 mol% silver iodide to pAg 9.1, 3.0 mg of potassium chloroaurate and 0.15 g of ammonium thiocyanate were added to the silver halide emulsion per mol of silver halide and then after further adding thereto the compound shown in Table 2, the resulting mixture was heated for 50 minutes at 60° C. for performing ripening. The silver halide emulsion was adjusted to pAg 8.7 and after adding thereto the stabilizer, the wetting agent, and the hardening agent as in Example 1, the silver halide emulsion was coated on a film support. Thus, samples 11 to 17 were prepared. One set of these samples were subjected immediately to the following exposure, development, and test for photographic properties, while another set of the samples were preserved for 4 days at a temperature of 50° C. and a relative humidity of 70% and then subjected to the following exposure, development and test. That is, each of both sets of samples was exposed using a sensitometer as in Example 1, developed for 30 seconds at 35° C. using a developer, RD-III (made by Fuji Photo Film Co., Ltd.) for automatic processor, and then tested on the photographic properties. The results are shown in Table 2.

In addition, the sensitivities in Table 2 are shown relatively with the sensitivity of sample 11 being taken 100 as in Example 1.

TABLE 2

| Sample No. | Compound | Addition Amount (mol) | Immediately after Coating Sensitivity | Immediately after Coating Fog | 4 Days, 50° C., RH 70% Sensitivity | 4 Days, 50° C., RH 70% Fog |
|---|---|---|---|---|---|---|
| 11 | (A) | $5 \times 10^{-5}$ | 100 | 0.21 | 75 | 0.41 |
| 12 | (A) | $1 \times 10^{-5}$ | 65 | 0.12 | 62 | 0.28 |
| 13 | (B) | $5 \times 10^{-5}$ | 125 | 0.18 | 100 | 0.36 |
| 14 | 4 | $1 \times 10^{-5}$ | 141 | 0.15 | 132 | 0.24 |
| 15 | 6 | " | 155 | 0.13 | 145 | 0.19 |
| 16 | 12 | " | 146 | 0.13 | 141 | 0.20 |
| 17 | 18 | " | 158 | 0.13 | 141 | 0.22 |
| 18 | 20 | " | 160 | 0.13 | 145 | 0.22 |

Comparison compounds (A) and (B) are same as those shown in Table 1.

As is clear from the results shown in Table 2, the samples using the compounds of this invention not only showed increased photographic sensitivity with less formation of fog when tested immediately after coating but also maintained stable sensitivity and less formation of fog when tested after preserving for 4 days at a temperature of 50° C. and a relative humidity of 70%.

EXAMPLE 3

After adjusting a silver iodobrimide gelatino emulsion (mean grain size of silver halide grains being 0.8 micron) containing 6 mol% silver iodide to pAg 9.1, 3.5 mg of potassium chloroaurate and 0.18 g of ammonium thiocyanate were added to the silver halide emulsion per mol of silver halide and after further adding thereto the compound shown in Table 3, the resultant mixture was heated for 60 minutes at 60° C. to perform ripening. Then, the additives described below were added to the silver halide emulsion and the emulsion was coated on a film support and dried at a dry thickness of 6.0 microns. Thus, samples 21 to 28 were prepared. Each of the samples are exposed (1/20 second) through a yellow filter, developed according to Process I described in Example 1 of Japanese Patent Application (OPI) No. 51940/76 (in this case, however, Color Developer C was used), and tested on the photographic properties. The results obtained are shown in Table 3.

In addition, the sensitivities in Table 3 are shown relatively with the sensitivity of sample 21 being takne 100.

Additives:

Coupler: 1-(2,4,6-trichlorophenyl)-3-[3-(2,4-di-t-amylphenoxy)acetamido]benzamido-5-pyrazolone (0.75 g/m$^2$)

Spectral sensitizer: bis{2-[1-ethyl-3-(3-sulfopropyl)-5,6-dichlorobenzimidazole]}trimethinecyanine sodium salt (5.2 mg/m$^2$)

Stabilizer: 4-hydroxy-6-methyl-1,3,3a,7-tetraazaindene

Hardening agent: 2,4-dichloro-6-hydroxy-1,3,5-triazine sodium salt (14 mg/m$^2$)

Wetting agent: sodium p-dodecylbenzenesulfonate (31 mg/m$^2$); sodium p-nonylphenoxypoly(ethyleneoxy)propane sulfonate (60 mg/m$^2$)

TABLE 3

| Sample No. | Compound | Addition Amount (mol) | Relative Sensitivity | Fog |
|---|---|---|---|---|
| 21 | (A) | $1.0 \times 10^{-4}$ | 100 | 0.18 |
| 22 | (A) | $2.5 \times 10^{-5}$ | 85 | 0.15 |
| 23 | (B) | $1.0 \times 10^{-4}$ | 120 | 0.18 |
| 24 | 2 | $2.5 \times 10^{-5}$ | 160 | 0.14 |
| 25 | 7 | " | 148 | 0.14 |
| 26 | 10 | " | 166 | 0.14 |
| 27 | 19 | " | 160 | 0.13 |
| 28 | 22 | " | 152 | 0.13 |

Compounds (A) and (B) are same as those shown in Table 1.

As is clear from the results shown in Table 3, the samples using the compounds of this invention showed high photographic sensitivity without an accompanying increase in fog formation.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing the compound represented by the formula:

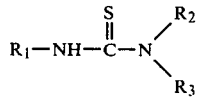

wherein $R_1$ represents a 5-membered or 6-membered heterocyclic residue containing a nitrogen atom selected from the group consisting of a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring and a naphthoselenazole ring; $R_2$ represents a hydrogen atom, a lower alkyl group, an allyl group, an aryl group, or an aralkyl group; and $R_3$ has the same meaning as $R_1$ or $R_2$; or $R_2$ and $R_3$ may combine to form a heterocyclic ring, wherein the amount of said compound is a sensitizing and antifogging amount within the range from $5 \times 10^{-6}$ mol to $1\times10^{-3}$ mol per mol of silver halide in the silver halide photographic emulsion.

2. The silver halide photographic emulsion of claim 1, wherein said compound is added to the silver halide photographic emulsion at the initiation of chemical ripening of it.

3. The silver halide photographic emulsion of claim 2, wherein the pAg of the silver halide emulsion upon chemical ripening is about 8.0 to 11.0.

4. The silver halide photographic emulsion of claim 1, wherein said silver halide is silver bromide or silver iodobromide.

5. The silver halide photographic emulsion of claim 1, wherein said 5-membered or 6-membered heterocyclic ring represented by $R_3$ is selected from the group consisting of a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring and a naphthoselenazole ring.

6. The silver halide photographic emulsion of claim 5, wherein said heterocyclic ring is substituted by an alkyl group, an alkoxy group, an aryl group, a halogen atom, an alkylthio group, an aralkyl group, an amido group, a sulfo group, a carboxy group, an alkoxysulfonyl group or an alkoxycarbonyl group.

7. The silver halide photographic emulsion of claim 1, wherein said alkyl group represented by $R_2$ is an alkyl group having 1 to 6 carbon atoms which may be substituted by a hydroxy group, a cyano group or an amino group.

8. The silver halide photographic emulsion of claim 1, wherein said aryl group represented by $R_2$ is a phenyl group, a naphthyl group, a p-tolyl group, or a p-chlorophenyl group.

9. The silver halide photographic emulsion of claim 1, wherein said ring formed by $R_2$ and $R_3$ is selected from the group consisting of a morpholine ring, a piperidine ring, a piperazine ring or a pyrrolidine ring.

10. The silver halide photographic emulsion of claim 1, wherein said emulsion additionally contains an antifoggant.

11. The silver halide photographic emulsion of claim 1, wherein said emulsion additionally contains a color image forming coupler.

12. A photographic material comprising a support having coated thereon at least one silver halide photographic emulsion containing a compound represented by the formula:

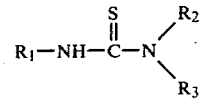

selected from the group consisting of a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring and a naphthoselenazole ring.

13. The silver halide photographic material of claim 12, wherein said compound is added to the siler halide photographic emulsion at the initiation of chemical ripening of it.

14. The silver halide photographic material of claim 13, wherein the pAg of the silver halide emulsion upon chemical ripening is about 8.0 to 11.0.

15. The silver halide photographic material of claim 12, wherein said silver halide is silver bromide or silver iodobromide.

16. The silver halide photographic material of claim 12, wherein said 5-membered or 6-membered heterocyclic ring represented by $R_3$ is selected from the group consisting of a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring and a naphthoselenazole ring.

17. The silver halide photographic material of claim 12, wherein said heterocyclic ring is substituted by an alkyl group, an alkoxy group, an aryl group, a halogen atom, an alkylthio group, an aralkyl group, an amido group, a sulfo group, a carboxy group, an alkoxysulfonyl group or an alkoxycarbonyl group.

18. The silver halide photographic material of claim 12, wherein said alkyl group represented by $R_2$ is an alkyl group having 1 to 6 carbon atoms which may be substituted by a hydroxy group, a cyano group or an amino group.

19. The silver halide photographic material of claim 12, wherein said aryl group represented by $R_2$ is a phenyl group, a naphthyl group, a p-tolyl group, or a p-chlorophenyl group.

20. The silver halide photographic material of claim 12, wherein said ring formed by $R_2$ and $R_3$ is selected from the group consisting of a morpholine ring, a piperidine ring, a piperazine ring or a pyrrolidine ring.

21. The silver halide photographic material of claim 12, wherein said emulsion additionally contains an antifoggant.

22. The silver halide photographic material of claim 12, wherein said emulsion additionally contains a color image forming coupler.

* * * * *